US005452170A

United States Patent [19]

Ohde et al.

[11] Patent Number: 5,452,170

[45] Date of Patent: Sep. 19, 1995

[54] COMMUTATION TYPE DC BREAKER

[75] Inventors: Shinichi Ohde; Shigetoshi Ouchi; Haruo Honda; Toru Yoshida; Tutomu Kanno; Yukio Kugoh, all of Hitachi, Japan

[73] Assignee: Hitachi, Ltd., Tokyo, Japan

[21] Appl. No.: 16,920

[22] Filed: Feb. 12, 1993

[30] Foreign Application Priority Data

Feb. 21, 1992 [JP] Japan ..... 4-035058

[51] Int. Cl.[6] ..... H01H 9/30

[52] U.S. Cl. ..... 361/13; 361/4; 361/9

[58] Field of Search ..... 361/4, 5, 9, 13, 58

[56] References Cited

U.S. PATENT DOCUMENTS 3,529,210 9/1970 Ito et al. ..... 361/58
4,740,858 4/1988 Yamaguchi et al. ..... 361/4
5,214,557 3/1993 Hasegawa et al. ..... 361/4

FOREIGN PATENT DOCUMENTS 2039065 2/1972 Germany .
3626589 2/1987 Germany .

OTHER PUBLICATIONS

A. Erik/M. Schmelzle, "Grundlagen der Schaltgeratetechnik", 1974, pp. 13–21.

*Primary Examiner*—Todd Deboer
*Attorney, Agent, or Firm*—Antonelli, Terry, Stout & Kraus

[57] ABSTRACT

A commutation type DC breaker having a commutation circuit electrically connected in parallel to a main contact. The main contact is connected between a DC power supply and a load. The commutation circuit is a series circuit of a commutation capacitor, a reactor and a commutation switch, with an energy absorption device electrically connected in parallel to the main contact. A switch or a breaker for preventing the flow of commutation current from the commutation circuit to the load in a non-load opening mode is connected between an electrical connection point (P), of the main contact and the commutation circuit, and the load and is opened substantially simultaneously with the opening of the main contact, or before the closure of the commutation switch. In this manner, the safety on the load in the non-load opening mode is enhanced.

15 Claims, 2 Drawing Sheets

COMMUTATION TYPE DC BREAKER

BACKGROUND OF THE INVENTION

The present invention relates to a commutation type DC breaker having a commutation circuit electrically connected in parallel to a main contact, and more particularly to one which inserts a back current by using a commutation capacitor chargeable directly from a DC main line.

A prior art back current insertion type DC breaker is described in "DC Breaker", Electricity Review, September 1980, pp 791~795.

Another prior art commutation type DC breaker is disclosed in JP-A-54-149873 and a circuit diagram thereof is shown in FIG. 1, in which a main contact 1 is connected to a DC main line 15 between a DC power supply 11 and a load 12, and a commutation circuit comprising a series circuit of a commutation capacitor 2, a reactor 3 and a commutation switch 4, and an energy absorption device 5 are electrically connected in parallel to the main contact 1.

A current detector 14 for detecting an abnormal current, when such an abnormal current flows through the DC main line 15, and an overcurrent tripping device 13 for commanding actuation of a control device 6 to open the main contact 1 are provided between an electrical connection point P, between of the main contact 1 and the commutation circuit, and load 12.

The break of the main circuit current is first detected by the current detector 14 which detects the abnormal current, and the control device 6 is actuated by the command from the overcurrent tripping device 13. Then, the main contact 1 is opened by the control device 6, and then the commutation switch 4 of the commutation device is closed to direct an oscillating commutation current, which is of opposite direction to that of the main circuit current, to the main contact 1 to form a zero current point with the main circuit current so that the current is broken in a manner similar to that of AC current break.

However, through the evaluation of the prior art commutation type DC breaker by the inventors of the present invention, it has been revealed that there is a bad affect to the load 12 in a non-load open mode. Namely, it has been found that in the non-load open mode, the main contact 1 recovers its pole-to-pole insulation substantially simultaneously with the opening of the main contact 1, and when the commutation switch 4 is thereafter closed, a commutation current I from the commutation circuit does not flow through the main contact 1 but flows into the load 12. As a result, if an operator checks the line of the load 12 assuming that the current break is over, there is a risk that the operator will an electric shock.

SUMMARY OF THE INVENTION

It is a primary object of the present invention to provide a commutation type DC breaker which has an improved safety on a load in a non-load opening mode.

It is another object of the present invention to allow selection of a desired timing of opening between a main contact and a blocking means.

It is a further object of the present invention to build the blocking means in a commutation circuit so as to integrate them into a unit.

In order to achieve the above objects, the commutation type DC breaker of the present invention comprises a main contact connected between a DC power supply and a load, a commutation circuit comprising a series circuit of a capacitor, a reactor and a commutation switch, electrically connected in parallel to the main contact, and blocking means for blocking flow of a commutation current from the commutation circuit to the load in a non-load opening mode.

The commutation type DC breaker of the present invention blocks the flow of the commutation current from the commutation circuit to the load in the non-load opening mode by the blocking means. Accordingly, the commutation current does not flow into the load in the non-load opening mode and the safety of checking the load is enhanced.

BRIEF DESCRIPTION OF THE DRAWINGS

Preferred embodiments of the present invention will be described in conjunction with the accompanying drawings, in which.

DESCRIPTION OF THE PREFERRED EMBODIMENTS

The preferred embodiments of the present invention are now described with reference to the drawings.

Figure 1:
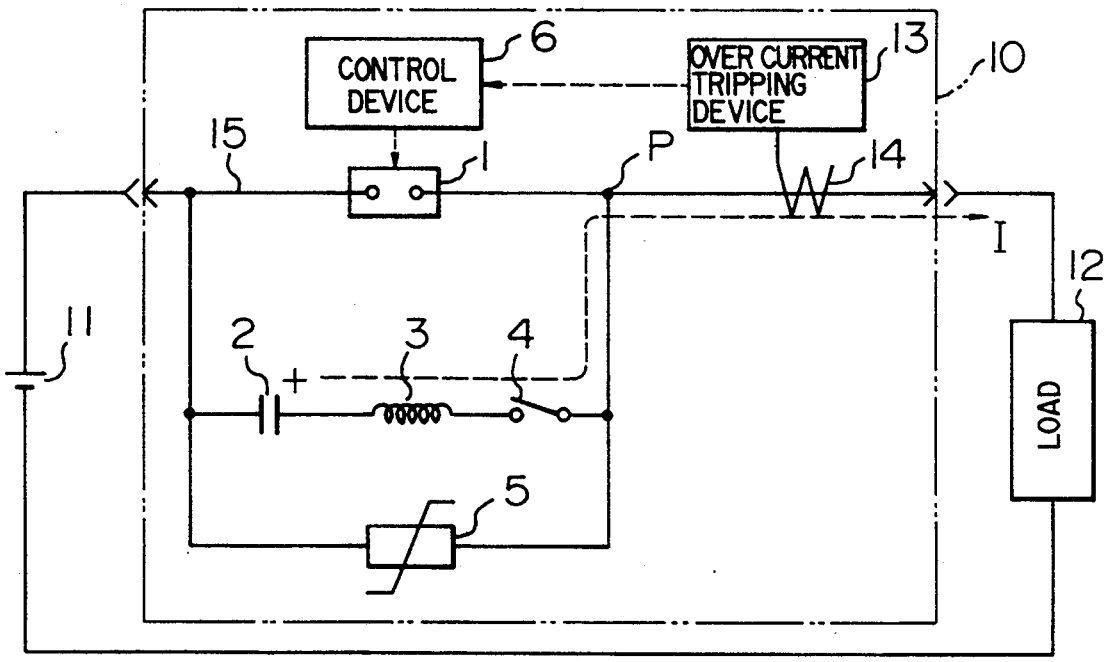
FIG. 1 PRIOR ART
FIG. 1 shows a circuit diagram of a prior art commutation type DC breaker.
Figure 2:
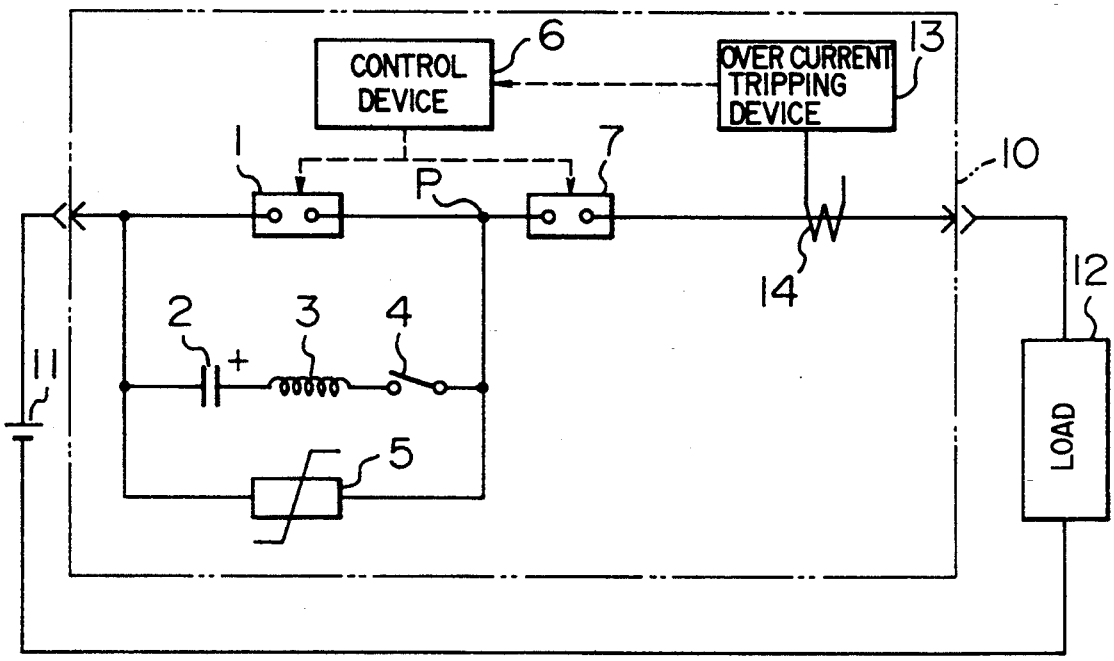
FIG. 2 shows a circuit diagram of a first embodiment of a commutation type DC breaker of the present invention.

FIG. 2 shows a circuit diagram of a first embodiment of the commutation type DC breaker of the present invention. In FIG. 2, the like elements to those of FIG. 1 are designated by the like numerals.

A main contact 1, such as a vacuum breaker is connected between a DC power supply 11 and a load 12, and a commutation circuit, comprising a series connection of a commutation capacitor 2, a reactor 3 and a commutation switch 4, and an energy absorption device 5, is electrically connected in parallel to the main contact 1, and a blocking means 7 for blocking flow of a commutation current from the commutation circuit to load 12 in a non-load opening mode is provided to complete a commutation type DC breaker 10.

Further, a current detector 14 for detecting an abnormal current when such an abnormal current flows in the main circuit, and an overcurrent tripping device 13 for commanding actuation of a control device 6 to open the main contact 1 are provided between-the blocking means 7 and the load 12. The blocking means 7 is provided between an electrical connection point P, of the main contact 1 and the commutation circuit, and the load 12, and it may comprise a contact which is opened and closed simultaneously with the main contact 1 by the control device 6 of the main contact 1. The blocking means may be a vacuum breaker, an air breaker, a magnetic breaker or a relay.

The break of the main circuit current is first detected by the current detector 14 which detects the abnormal current, and the control device 6 is actuated by the command from the overcurrent tripping device 13 to open the main contact 1, and after the detection of the opening, the commutation switch 4 of the commutation circuit is closed to direct an oscillating commutation current, of the opposite direction to that of the main circuit current, into the main contact 1 to form a zero current point with the main circuit current. However, in the non-load opening mode, the pole-to-pole insulation of the main contact 1 recovers simultaneously with the opening thereof, and the pole-to-pole insulation of the blocking means 7 which is opened by the same control device 6 is also recovered. Accordingly, when the commutation switch 4 is later closed, the commutation capacitor 2 discharges through the reactor 3 to supply a commutation current I. However, since the main contact 1 has been opened as described above, it does not flow therethrough. Since the blocking means 7 is also open, the commutation current I does not flow therethrough either. As a result, the commutation current I is consumed by the energy absorption device 5 which may be an arrestor and does not flow into the main circuit. In this manner, the flow of the commutation current into the load 12 is blocked, and there is no risk of electric shock of an operator even if the operator starts work inspection work while assuming that the break of the main circuit current on the load 12 is completed.

In the first embodiment described above, the main contact 1 and the blocking means 7 are actuated by the same control device 6 to form a so-called series two-break point, although they may be opened and closed by separate control devices.

Figure 3:
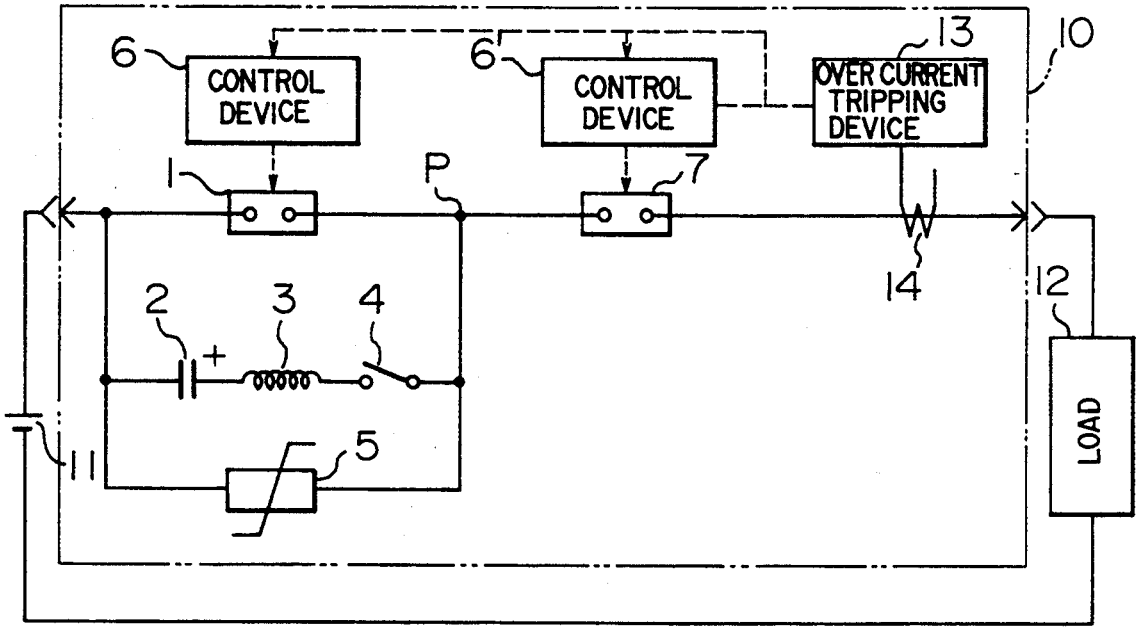
FIG. 3 shows a circuit diagram of a second embodiment of the commutation type DC breaker of the present invention.

FIG. 3 shows a circuit diagram of a second embodiment of the commutation type DC breaker of the present invention. In FIG. 3, the like elements to those of FIG. 2 are designated by the like numerals.

The main contact 1 is opened and closed by the control device 6, and the blocking means 7 is opened and closed by another control device 6'.

The blocking means 7 is opened substantially simultaneously with the main contact 1, or it is opened at latest before the closure of the commutation switch 4.

By actuating the main contact 1 and the blocking means 7 by separate control devices 6 and 6', the respective control devices 6 and 6' may be of compact size and the timings of opening of the main contact 1 and the blocking means 7 may be selected as desired.

In the first and second embodiments described above, the blocking means 7 is provided between the electrical connection point P, of the commutation circuit and the main contact 1, and the load 12, although it may be arranged between the commutation switch 4 and the main contact 1.

Figure 4:
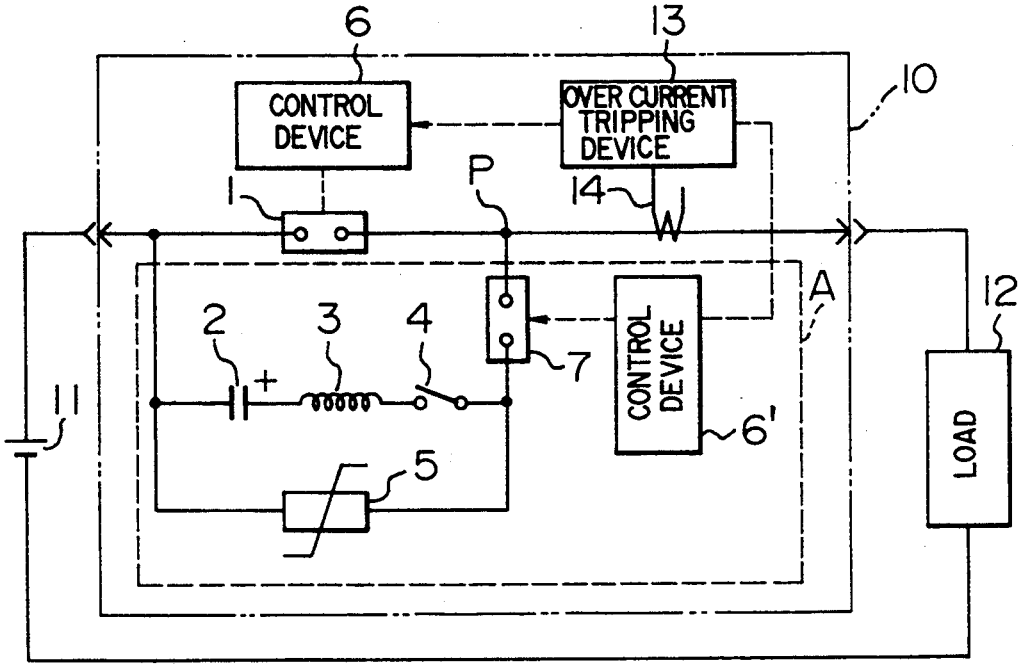
FIG. 4 shows a circuit diagram of a third embodiment of the commutation type DC breaker of the present invention.

FIG. 4 shows a circuit diagram of a third embodiment of the commutation type DC breaker of the present invention. In FIG. 4, the like elements to those of FIG. 3 are designated by the like numerals.

The blocking means 7 is connected between the commutation switch 4 and the main contact 1, and it is actuated by the separate control device 6' although it may be actuated by the control device 6 which actuates the main contact 1.

In any case, the configuration is such that the flow of the commutation current into the load 12 is prevented.

By the present configuration, the blocking means 7 may be built in the commutation circuit which comprises the commutation capacitor 2, the reactor 3 and the commutation switch 4 so that a block A circled by broken lines can be integrated into a unit.

In accordance with the present invention, since the blocking means for blocking the flow of the commutation current into the load is provided, the following advantages are offered:

1. The flow of the commutation current into the load is prevented, and the safety of an operator who inspects the load is enhanced.
2. Where the main contact and the blocking means are actuated by the separate control devices, the respective control devices may be of compact size and the timings of opening of the main contact and the blocking means can be selected as desired.
3. The blocking means may be built in the commutation circuit to integrate them into a unit.

What is claimed is:

1. A commutation type DC breaker comprising:

a main contact adapted to be connected between a DC power supply and a load;

a commutation circuit, including a series connection of a commutation capacitor, a reactor and a commutation switch, electrically connected in parallel to said main contact;

a current detector for detecting a non-load current passing through the load;

blocking means for blocking flow of a commutation current from said commutation circuit to the load;

control means responsive to detection of the non-load current, for opening said main contact, to cause a commutation current to flow from said commutation circuit, and for actuating said blocking means, to block flow of the commutation current to the load.

2. A commutation type DC breaker according to claim 1 wherein said blocking means comprises a contact which opens substantially simultaneously with the opening of said main contact or before the closure of said commutation switch.

3. A commutation type DC breaker according to claim 1 wherein said control means comprises a single control device for opening said main contact and actuating said blocking means.

4. A commutation type DC breaker according to claim 1 wherein said control means comprises a first control device for opening said main contact and a second control device for actuating said blocking means.

5. A commutation type DC breaker according to claim 1 wherein said blocking means is provided between an electrical connection point (P), which connects said commutation circuit and said main contact, and the load.

6. A commutation type DC breaker according to claim 1 wherein said blocking means comprises a vacuum breaker.

7. A commutation type DC breaker according to claim 1 wherein said blocking means is provided between said main contact and said commutation switch.

8. A commutation type DC breaker according to claim 5 wherein said control means comprises a single control device for opening said main contact and actuating said blocking means.

9. A commutation type DC breaker according to claim 5 wherein said control means comprises a first control device for opening said main contact and a second control device for actuating said blocking means.

10. A commutation type DC breaker according to claim 7 wherein said control means comprises a single control device for opening said main contact and actuating said blocking means.

11. A commutation type DC breaker according to claim 7 wherein said control means comprises a first control device for opening said main contact and a second control device for actuating said blocking means.

12. A commutation type DC breaker according to claim 1 wherein said blocking means comprises an air breaker.

13. A commutation type DC breaker according to claim 1 wherein said blocking means comprises a magnetic breaker.

14. A commutation type DC breaker according to claim 1 wherein said blocking means comprises a relay.

15. A commutation type breaker as claimed in claim 1, wherein said commutation circuit further includes an energy absorption device connected in parallel to the main contact, to absorb the electrical energy of the commutation current.

* * * * *